US009979116B2

(12) United States Patent
Hinsch et al.

(10) Patent No.: US 9,979,116 B2
(45) Date of Patent: May 22, 2018

(54) MODULAR POWER SUPPLY FOR ENGAGEMENT WITH A POWER CORD

(71) Applicant: EJ Technologies, LLC, Glendale, AZ (US)

(72) Inventors: Eric A. Hinsch, Glendale, AZ (US); Jonathan D. Sands, Peoria, AZ (US); Thomas G. Canady, Phoenix, AZ (US)

( * ) Notice: Subject to any disclaimer, the term of this patent is extended or adjusted under 35 U.S.C. 154(b) by 0 days. days.

(21) Appl. No.: 15/703,919

(22) Filed: Sep. 13, 2017

(65) Prior Publication Data

US 2018/0076556 A1 Mar. 15, 2018

Related U.S. Application Data

(60) Provisional application No. 62/394,121, filed on Sep. 13, 2016.

(51) Int. Cl.

| | |
|---|---|
| ***H01R 4/24*** | (2018.01) |
| ***H01R 13/514*** | (2006.01) |
| ***H01R 9/24*** | (2006.01) |
| ***H01R 25/00*** | (2006.01) |
| ***H01R 13/74*** | (2006.01) |

(52) U.S. Cl.

CPC ..... *H01R 13/514* (2013.01); *H01R 9/2408* (2013.01); *H01R 13/74* (2013.01); *H01R 25/003* (2013.01); *H01R 4/2433* (2013.01)

(58) Field of Classification Search

None

See application file for complete search history.

(56) References Cited

U.S. PATENT DOCUMENTS

| | | | | |
|---|---|---|---|---|
| 7,646,259 | B2 * | 1/2010 | Chang | H01R 4/242 333/25 |
| 2013/0260619 | A1 * | 10/2013 | Wallner | H01R 9/2425 439/709 |
| 2014/0256165 | A1 * | 9/2014 | Chang | H01R 4/2433 439/153 |

* cited by examiner

*Primary Examiner* — Tho D Ta

(74) *Attorney, Agent, or Firm* — Thomas W. Galvani, P.C.; Thomas W. Galvani

(57) ABSTRACT

A modular power supply for connecting to a power cord includes a housing defining an interior, a cover releasably engaged to the housing to enclose the interior, and a carrier plate within the interior including opposed primary channels configured to receive the power cord. A control assembly is within the interior and includes a logic controller electrically coupled to spikes extending outside of the control assembly and through the primary channels, as well as a charging port electrically coupled to the spikes via the logic controller. The cover is applicable to the carrier plate so as to define a hold that captures the power cord on the spikes in the primary channels when the power cord is applied to the primary channels.

15 Claims, 8 Drawing Sheets

MODULAR POWER SUPPLY FOR ENGAGEMENT WITH A POWER CORD

CROSS-REFERENCE TO RELATED APPLICATIONS

This application claims the benefit of U.S. Provisional Application No. 62/394,121, filed Sep. 13, 2016, which is hereby incorporated by reference.

FIELD OF THE INVENTION

The present invention relates generally to electronics, and more particularly to consumer electronic charging devices.

BACKGROUND OF THE INVENTION

Electronic devices such as cell phones, laptops, or tablets contain batteries that must be re-charged periodically. Although battery technology is continuously improving, consumers use these devices constantly and demand an increasing amount of capability from them, which quickly drains the batteries. Charging of such devices is thus an important and necessary part of their operation. Such devices are usually purchased together with an included charger, sometimes referred to as a power supply or adapter. Conventional chargers are AC adapters with prongs that plug into a wall outlet to access the alternating current ("AC") power supply of a building. They typically have internal circuitry that converts the AC power to direct current ("DC") power and lowers the voltage so that it is useable by the device. A cord connected to the adapter plugs into the device and delivers power to it. The cords, especially those of cell phone chargers, are generally short, such as around three feet or less in length. Short cords are generally preferred: since the devices are highly portable, it is desirable for the chargers to be highly portable as well, and longer cords make the charger cumbersome and difficult to carry. However, whether the cords are long or short, keeping track of them can sometimes be difficult: because chargers are designed to be portable like the devices they charge, users often travel with them, plug them into different locations, and eventually lose them. It can be incredibly frustrating to be unable to find a charger when one's mobile device is low on power.

The availability of outlets ultimately determines where a user can charge his or her device. Whatever the length of the charger cord, charging of the device is limited to locations within that distance of an outlet. The user must plug the device into the charger and leave it in that location for some time as the battery charges. A user might also want to connect the device to external power not just for charging, but to avoid running on battery power. For example, running on external power is desirable while using a device for a demanding task like streaming a movie or video chatting, and, as a result, some people prefer to operate their mobile devices while plugged in to avoid draining the battery. Buildings, however, are constructed with a limited number of outlets and are generally not designed to make charging a mobile device easier. This limits the options for locations in which a device may be connected to power. Outlets may be occupied by other devices or appliances, or may be too far from a desired location for the user. A user streaming video on a couch may not be able to watch while connected to power if the closest outlet is more than three feet from the couch.

Installing more outlets in a building is possible but requires small-scale demolition, reconstruction, and labor and skill. Running power to a location that is beyond the cord length of an outlet requires the use of an extension cord, but those are not desirable in many environments, especially home or office, because they are not aesthetically pleasing and can be an obstacle such as a trip hazard. An improved system for supplying power to mobile electronic devices is needed.

SUMMARY OF THE INVENTION

A modular power supply for connecting to a power cord includes a housing defining an interior, a cover releasably engaged to the housing to enclose the interior, and a carrier plate within the interior including opposed primary channels configured to receive the power cord. A control assembly is within the interior and includes a logic controller electrically coupled to spikes extending outside of the control assembly and through the primary channels, as well as a charging port electrically coupled to the spikes via the logic controller. The cover is applicable to the carrier plate so as to define a hold that captures the power cord on the spikes in the primary channels when the power cord is applied to the primary channels.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
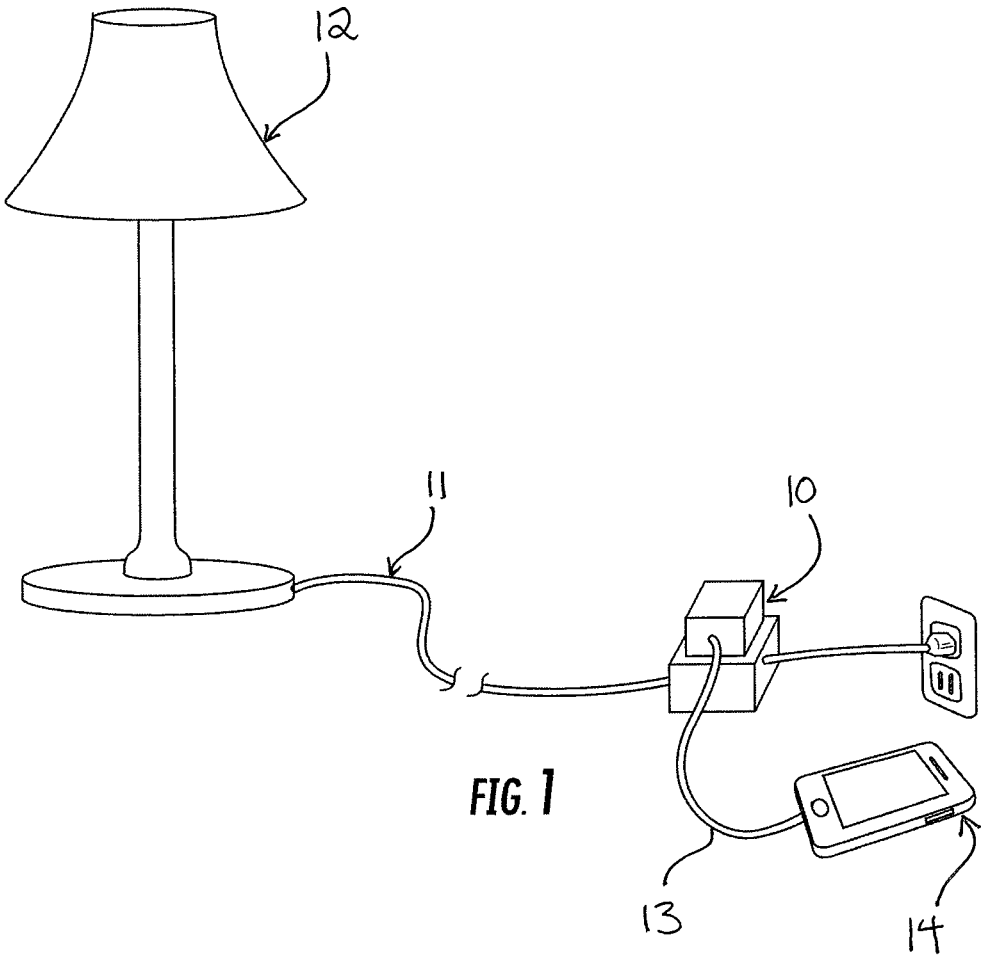
FIG. 1 illustrates a modular power supply for engagement with a power cord, the power supply connected to a power cord and to a charging cord which is in turn coupled to a mobile device.

Reference now is made to the drawings, in which the same reference characters are used throughout the different figures to designate the same elements. FIG. 1 is a top perspective view illustrating a modular power supply (hereinafter, "power supply 10") applied to a power cord 11 such that the power supply 10 draws power from the cord 11 rather than directly from an outlet. The cord 11 is exemplary of a power cord for an electric appliance 12 that is typically already present and plugged into an outlet without an adapter. In other words, the cord 11 generally carries full 110-120 VAC power before it has been stepped down by the circuitry of the electric appliance 12 to which it belongs. For example, the cord 11 could be the power cord for a lamp in the user's home; such a cord 11 carries power to the lamp for use in lighting a part of a room. The cord 11 provides 110-120 VAC power to internal circuitry within the lamp, and the internal circuitry transforms the power, but only for the lamp. The power supply 10 draws power before it is transformed by the lamp. A charging cable 13 extends from the power supply 10 to an electronic device 14.

It should be noted that a DC-DC version of the power supply 10 is within the scope of this disclosure and would require only minor modification of the electronic components described below. Briefly, the term "user" refers to a person using power supply 10 to charge an electronic device 14 such as a cell phone, tablet, laptop, or other similar mobile device or other electronic device in need of charging. The power supply 10 includes a housing, a cover, and internal structural elements which cooperate with each other to clamp onto the cord 11 and provide power to the electronic device 14 from a semi-permanent location remote from an outlet.

Figure 2:
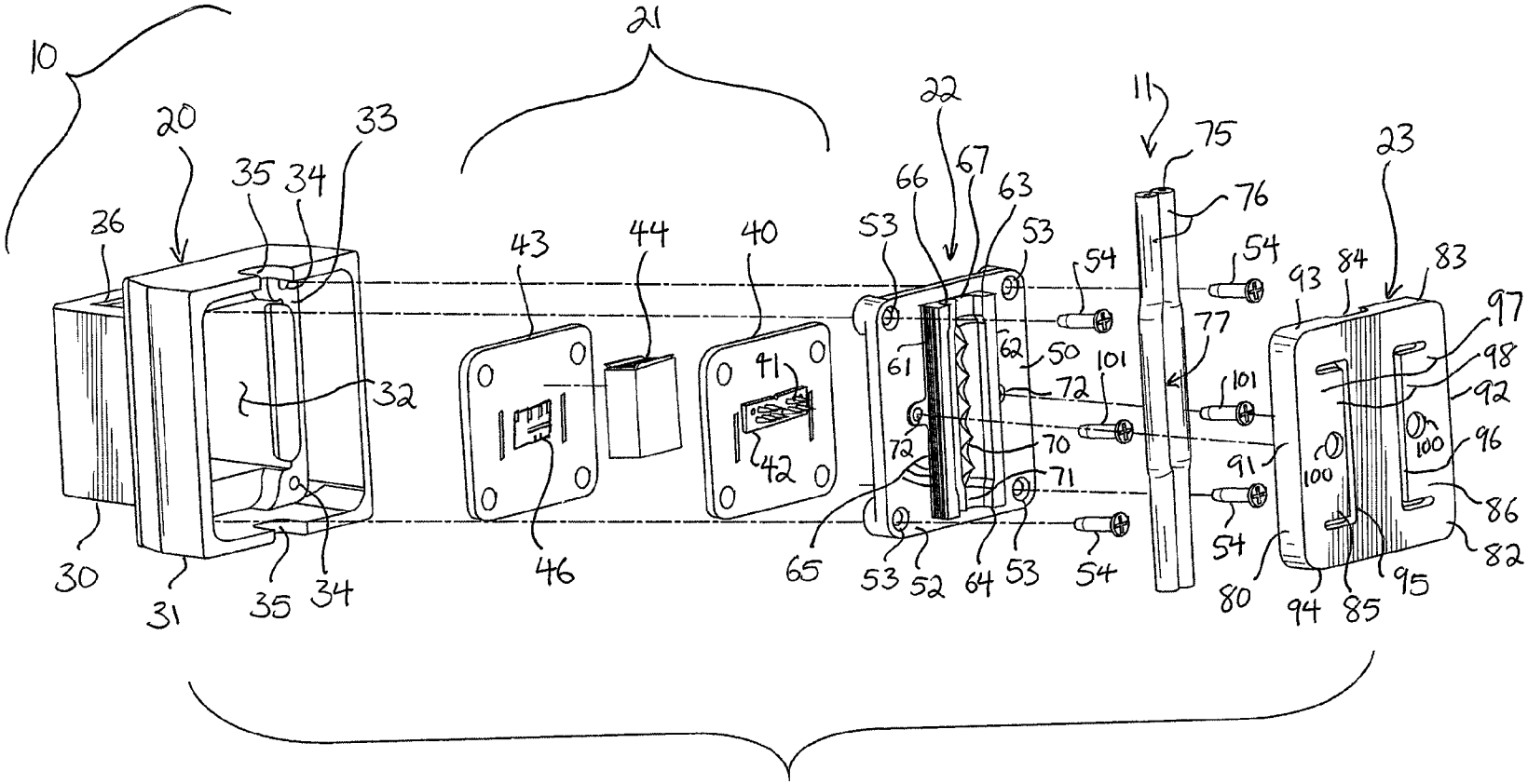
FIGS. 2 and 3 are bottom and top exploded views of the modular power supply of FIG. 1, respectively.
Figure 3:
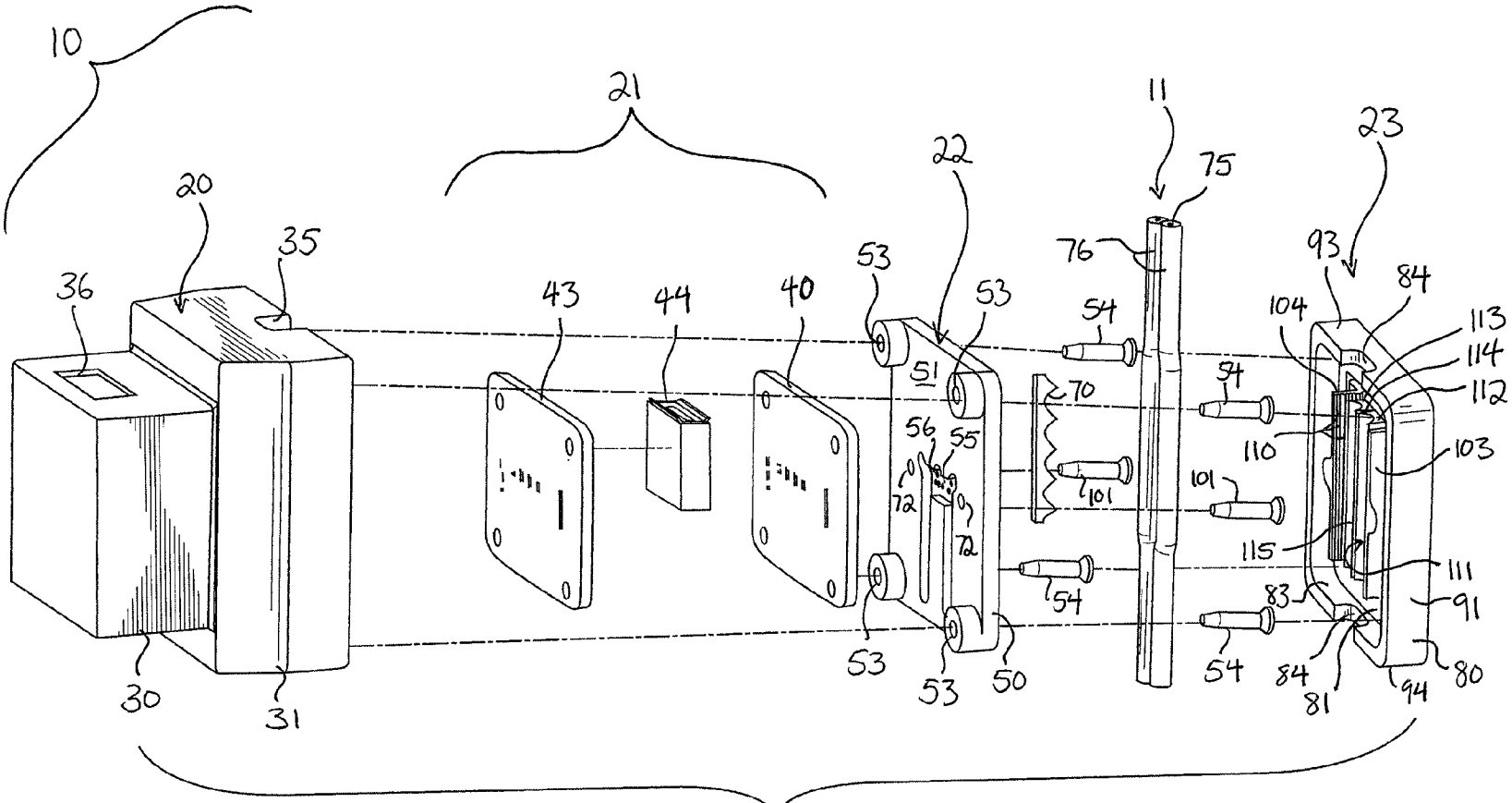
Figure 4:
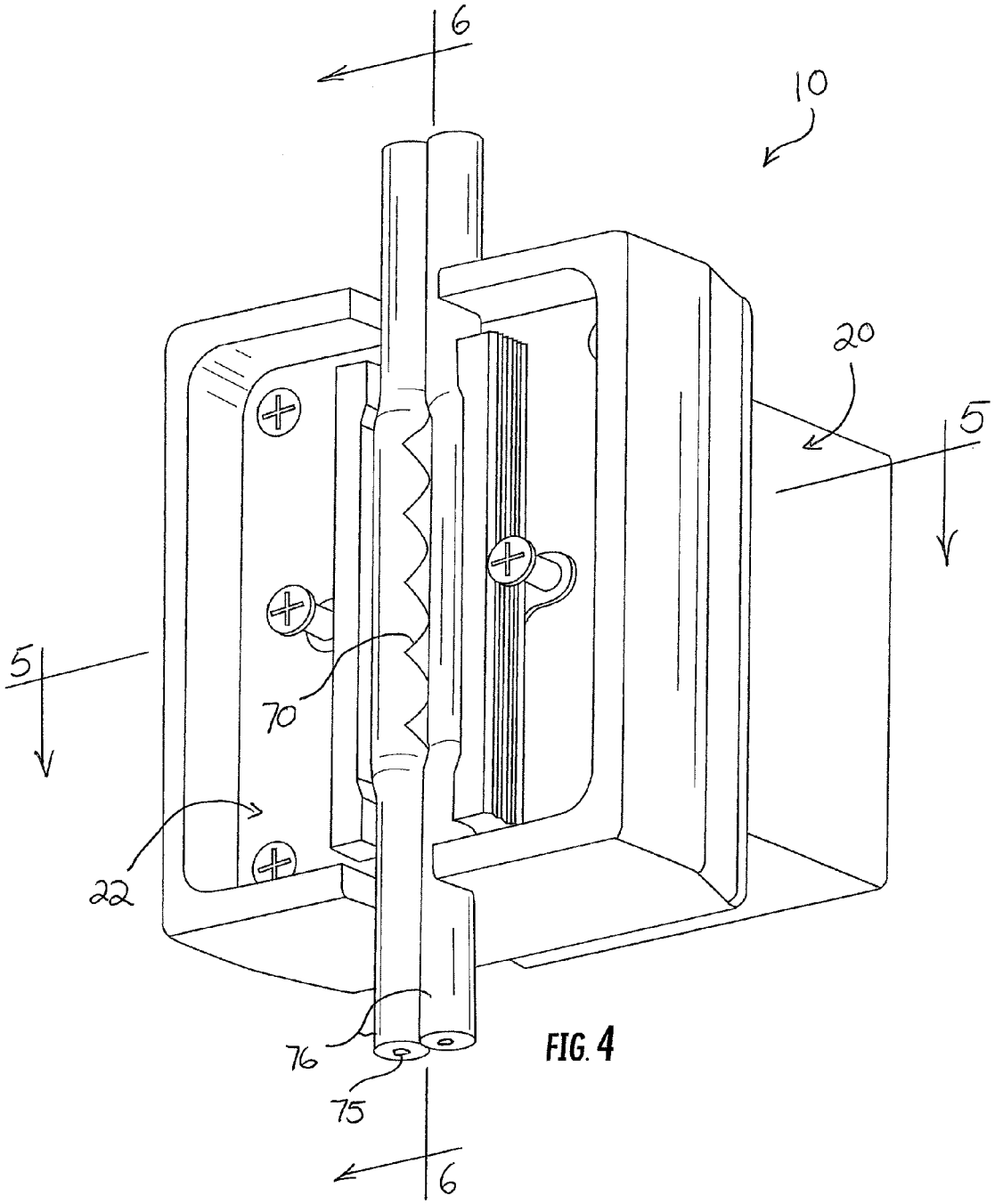
FIG. 4 is a bottom perspective view of the modular power supply with a cover of the modular power supply removed.

Turning to FIGS. 2 and 3, the power supply 10 is shown in exploded detail. The power supply 10 includes a main outer housing 20, a control assembly 21 nested inside the housing 20 and providing electronic control and charging capabilities, a carrier plate 22 secured to the housing 20 which separates and captures the cord 11, and a cover 23 secured over the cord 11 and against the carrier plate 22, thereby holding the cord 11 within the power supply 10.

The housing 20 is a non-conductive cover, preferably constructed from a material or combination of materials having durable, rigid, and electrically-insulative material characteristics. The housing 20 is a continuous sidewall with an upper portion 30 and a lower portion 31 formed monolithically to each other from the sidewall. The upper portion 30 is roughly cube-shaped, and the lower portion 31 is roughly rectangular prismatic, with the housing 20 having an interior 32 which is also roughly cube-shaped to receive the control assembly 21. Within the interior 32, between the upper and lower portions 30 and 31, is a shoulder 33 that extends slightly into the interior 32 around the inner surface of the housing 20. The shoulder 33 is formed with four threaded holes 34 for securing the carrier plate 22. Additionally, two opposed notches 35 are formed in the sidewall of the housing 20 in the lower portion 31, so that the cord 11 may be received therethrough.

The interior 32 of the housing 20 receives the control assembly 21. The control assembly 21 includes a printed circuit board ("PCB") 40 carrying a set of spikes 41. There are preferably two rows of spikes 41, and the spikes 41 in one row are offset with respect to the spikes 41 in the other row. In the embodiment shown in FIG. 2, there are four spikes 41 in one row and six spikes 41 in the other row. The spikes 41 are carried on a spike plate 42 fixed to the PCB 40. While the spikes 41 are electrically conductive, the PCB 40 and spike plate 42 are made of non-conductive materials. The spikes 41 are each sharp on the outer ends, but their inner ends, extending just through the spike plate 42 (as seen in the section view of FIG. 5A) are dull. The inner ends of the spikes 41 are electrically coupled to the PCB 40 to provide power to the power supply 10.

The PCB 40 carries circuitry functionally equivalent to or structurally similar to conventional power supply circuitry for transforming AC power to stepped-down DC power, which uses components such as flyback converters, capacitors, inductors, and transformers to adapt, convert, transform, and smooth input power to be compatible with charging the electronic device 14. For example, cell-phone batteries typically use DC power provided at 5 volts, so power supplies for cell phones typically convert standard 120 VAC power from a standard wall outlet to DC power with a 5 volt potential. The PCB 40 and its associated circuitry converts AC power from the spikes 41 to DC voltage, steps down the voltage, and provides power usable by the electronic device 14. Via a ribbon cable 45 (shown only in FIG. 5A), the PCB 40 is electrically coupled to another PCB 43 carrying a charging Universal Serial Bus ("USB") port 44 for delivery of power to the electronic device 14. The PCB 43 carries circuitry, such as a logic controller 46, programmed to operate the USB port 44 and charge the electronic device 14 when a charging cable 13 is coupled thereto. The spikes 41 are coupled electrically to the PCB 43 and the logic controller 46 on it, and the logic controller 46 is thus in turn electrically coupled to the USB port 44, so that the logic controller 46 controls powering of the USB port 44 and charging of the electronic device 14 with a charging cable 13 plugged into the USB port 44. A slot 36 through the housing 20 provides external access to the USB port 44.

The control assembly 21 is carried within the housing 20. The control assembly 21 is snugly received therein, limited from lateral movement by the sidewall. The control assembly 21 is secured by fasteners through the PCBs 40 and 43 which are threadably engaged to the housing 20. To further secure the control assembly 21 in the housing 20, the carrier plate 22 is applied over it.

The carrier plate 22 includes a flat body 50 having a flat top 51 and an opposed flat bottom 52. On the top 51, four posts project upwardly and four holes 53 are formed entirely through them. These holes register with the holes 34 in the housing 20 so that the carrier plate 22 may be fastened to the housing 20 with fasteners 54. The fasteners 54 threadably engage the holes 53 and 34 to secure the carrier plate 21 into the housing 20, and to hold the control assembly 21 in the interior 32. In this way, the control assembly 21 is limited from downward movement by the carrier plate 21 and is further immobilized and stabilized.

A depression 55 is formed into the top 51 of the carrier plate 22 centrally thereon. The depression 55 is roughly rectangular has a plurality of small through-holes 56 formed therein. The depression 55 is sized to receive the spike plate 42; when the carrier plate 22 is fastened to the housing 20, the top 51 of the carrier plate 22 is brought into direct and flush contact with the PCB 40, and the spike plate 42 is received and seated within the depression 55. The spikes 41 pass through the holes 56, and the tips of the spikes 41 extend beyond the bottom 52 of the carrier plate 22.

A hold plate 60 is secured to the bottom 52 of the carrier plate 22. The hold plate 60 separates, locates, and captures the cord 11. The hold plate 60 is an elongate body having opposed outer sides 61 and 62 and opposed ends 63 and 64. The sides 61 and 62 are upstanding and ridged: each is formed with a plurality of longitudinal ridges 65 directed laterally outward. The ridges 65 extend entirely between the ends 63 and 64. Between the sides 61 and 62 are two primary channels 66 and 67 defined in the hold plate 60. The channels 66 and 67 are slightly more than semi-circular concave formations in the hold plate 60. The channels 66 and 67 are parallel, extend between the ends 63 and 64, are open at the ends 63 and 64, lie in adjacent juxtaposition proximate to the ends 63 and 64, but are separated slightly in an intermediate region between the ends 63 and 64. There, the channels 66 and 67 flank a blade 70 fixed between the channels 66 and 67. The blade 70 has a sharp serrated edge and is preferably constructed from a non-conductive material such as plastic, carbon fiber, or ceramic. The blade 70 is fixed in a crown 71 rising between the channels 66 and 67 and defining the channels 66 and 67 as separate channels. The blade 70 extends between the ends 63 and 64 but not entirely to the ends 63 and 64, stopping just short thereof. The crown 71, however, does extend fully between the ends 63 and 64 to separate the channels 66 and 67 along the full length of the hold plate 60.

The holes 53 in the carrier plate 22 extend through the channels 66 and 67. When the carrier plate 22 is applied to the housing 20 and the spikes 41 of the control assembly 21 pass through the holes 53, the spikes 41 extend not only through the body 50 of the carrier plate 22, but also through the channels 66 and 67. The tips of the spikes 41 are disposed just beyond the inner curved surface of the channels 66 and 67.

The blade 70 and crown 71 separate the cord 11. As seen in FIGS. 2 and 3, the cord 11 is a conventional power cord having two parallel cables 76, each having an internal wire 75 insulated in a non-conductive rubber or plastic jacket and joined along the middle of the cord 11. FIGS. 2 and 3 show a portion of the cord 11 in which the cables 76 are separated from each other, defining a longitudinal gap 77 therebetween. This gap 77 is formed when the cord 11 is placed into the carrier plate 22, not beforehand. As will be described in detail below, the blade 70 cuts the joining rubber between the two cables 76 and, with the crown 71, separates the two cables 76 from each other. The channels 66 and 67 then move the cables 76 apart from each other.

The position of the cord 11 within the channels 66 and 67 is maintained by the cover 23. The cover 23 includes a generally flat, planar body 80 having an inner surface 81 and an opposed bottom 82, as well as opposed sides 91 and 92 and opposed ends 93 and 94. A short, upstanding sidewall 83 extends continuously around the cover 23, bounding the inner surface 81. Notches 84 in the sidewall 83 at the ends 84 and 85 correspond to the notches 35 in the housing 20.

Two flexible panels 85 and 86 are integrally formed to the body 80. U-shaped slots 95 and 96 through the body 80 define the panels 85 and 86. The U-shaped slots 95 and 96 have ends directed toward the sides 91 and 92, respectively, and the slots 95 and 96 themselves extend generally between the ends 93 and 94. The panels 85 and 86 are thus integral to the body 80 only along living hinges 97, respectively, about which free ends 98 of the panels 85 and 86 can flex into and out of planar alignment with the body 80. Though the panels 85 and 86 are capable of flexing, the cover 23 is constructed from a fairly resilient, rigid, and durable material, and as such, the panels 85 and 86 flex only slightly under force.

Between the living hinges 97 and the free ends 98 of each of the panels 85 and 86 are holes 100 through which fasteners 101 threadably engage to secure the cover 23 to the carrier plate 22 at threaded holes 72 formed through the carrier plate 22. The holes 100 are in the panels 85 and 86, thereby allowing the cover 23 to be tightly engaged and secured to the carrier plate 22.

The cover 23 secures and holds the cord 11, in cooperation with the carrier plate 22. Referring just to FIG. 3 now, opposed upstanding lips 103 and 104 are fixed to the inner surface 81 of the cover 23. The upstanding lips 103 and 104 have inner faces which are ridged, or formed with a plurality of longitudinal ridges 110 directed laterally inward. The ridges 110 extend entirely along the lengths of the upstanding lips 103 and 104.

Just inside of the lips 103 and 104 are longitudinal gaps 111, and then, between the gaps 111, are two secondary channels 112 and 113. The channels 112 and 113 are slightly less than semi-circular concave formations. The channels 112 and 113 are parallel, extend along the full lengths of the lips 103 and 104, are open at their ends, and lie in adjacent juxtaposition proximate to each other, separated only by a split ridge 114. The split ridge 114 rises between the channels 112 and 113 to define them, but includes two ridges so that a very slight V-shaped, elongate channel or depression 115 is formed between the two ridges, or directly down the middle of the split ridge 114. The split ridge 114 extends fully along the lengths of the channels 112 and 113, and it receives the blade 70 when the cover 23 is secured to the carrier plate 22.

The channels 112 and 113 are formed directly to the inner surface 81 of the body 80 of the cover 23 at a non-moving location thereof. The upstanding lips 103 and 104, however, are carried on the inner surface 81 on the flexible panels 85 and 86, respectively. As such, the upstanding lips 103 and 104 are capable of moving slightly to ensure a tight fit on and good meshing engagement with the ridges 65 and 66, respectively, on the hold plate 60 of the carrier plate 22.

Figure 5A:
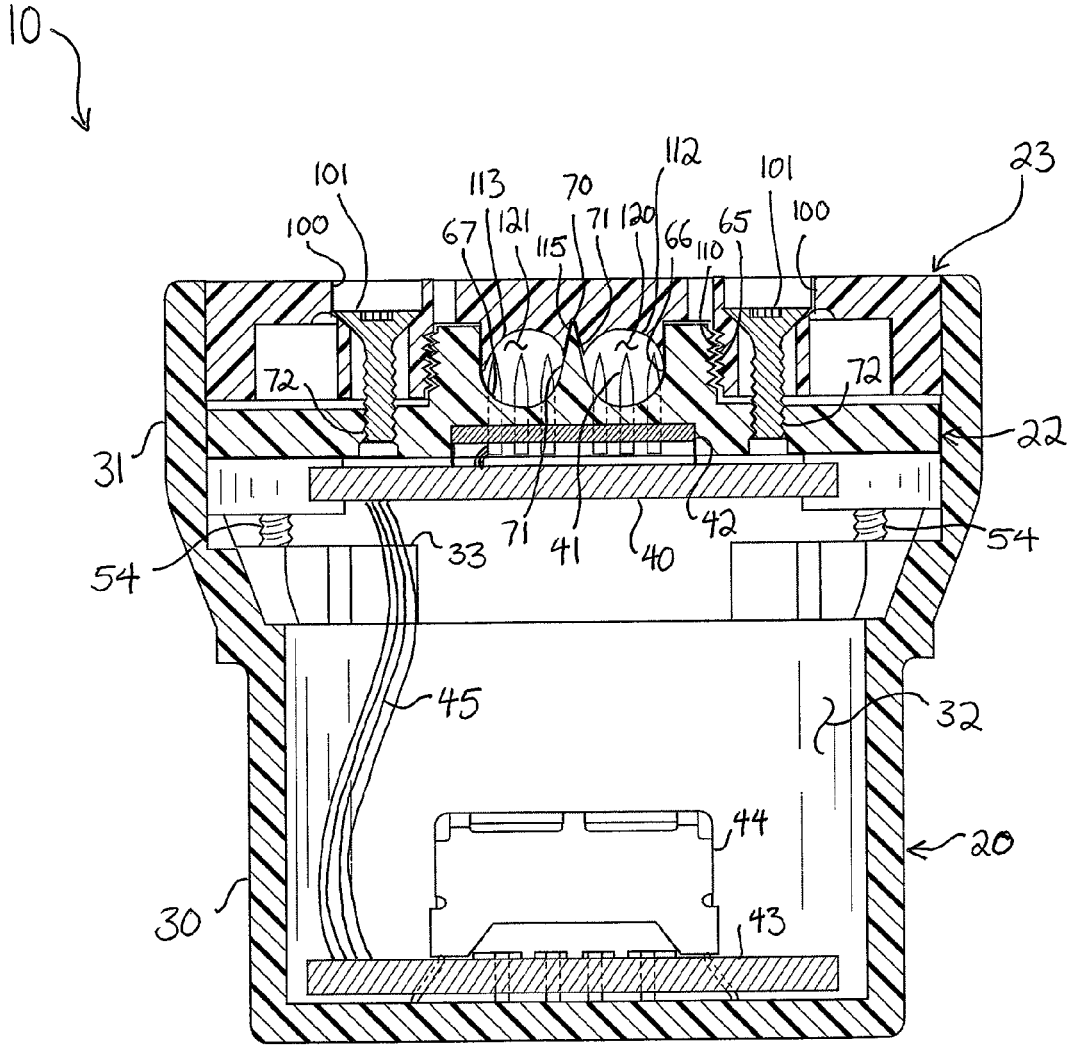
FIGS. 5A and 5B are section views taken along the line 5-5 in FIG. 4 illustrating the modular power supply without and with the power cord applied, respectively.
Figure 6A:
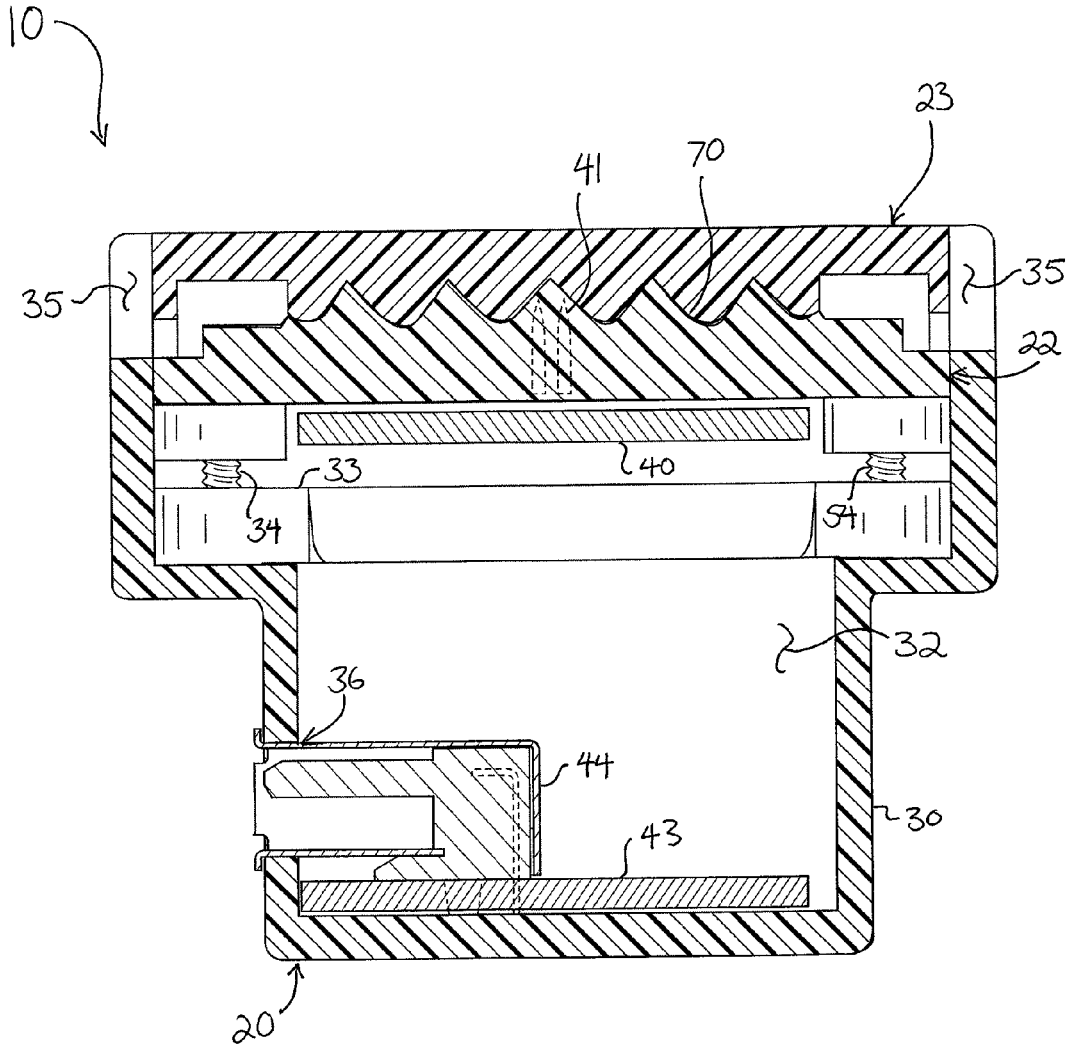
FIGS. 6A and 6B are section views taken along the line 6-6 in FIG. 4 illustrating the modular power supply without and with the power cord applied, respectively.

FIGS. 5A and 6A illustrate the power supply 10 in an assembled condition without the cord 11 applied thereto. Referring to those FIGS., the cover 23 is applied and secured to the housing 20 by the fasteners 101. When so arranged, the channels 112 and 113 of the cover 23 are opposite the channels 66 and 67 of the hold plate 60, and so the channels 112 and 113 define, in cooperation with the channels 66 and 67 on the carrier plate 22, parallel holds 112 and 113, which are a hold capturing the cord 11. The holds 112 and 113 are generally cylindrical, and are separated by the blade 70. The spikes 41 extend just slightly more than halfway through the holds 112 and 113, so that they will pierce a cord 11 applied to the holds 112 and 113.

As seen in FIGS. 5A and 6A, the PCB 40 is carried just behind the carrier plate 22, and the spikes 41 are electrically coupled thereto via a short set of wires. On the other side of the interior 32 of the housing 20, the PCB 43 is fixed to the housing 20. The USB port 44 is electrically coupled to the PCB 43 and extends through the slot 36 in the housing 20, so that a user may access the UDB port 44.

Figure 5B:
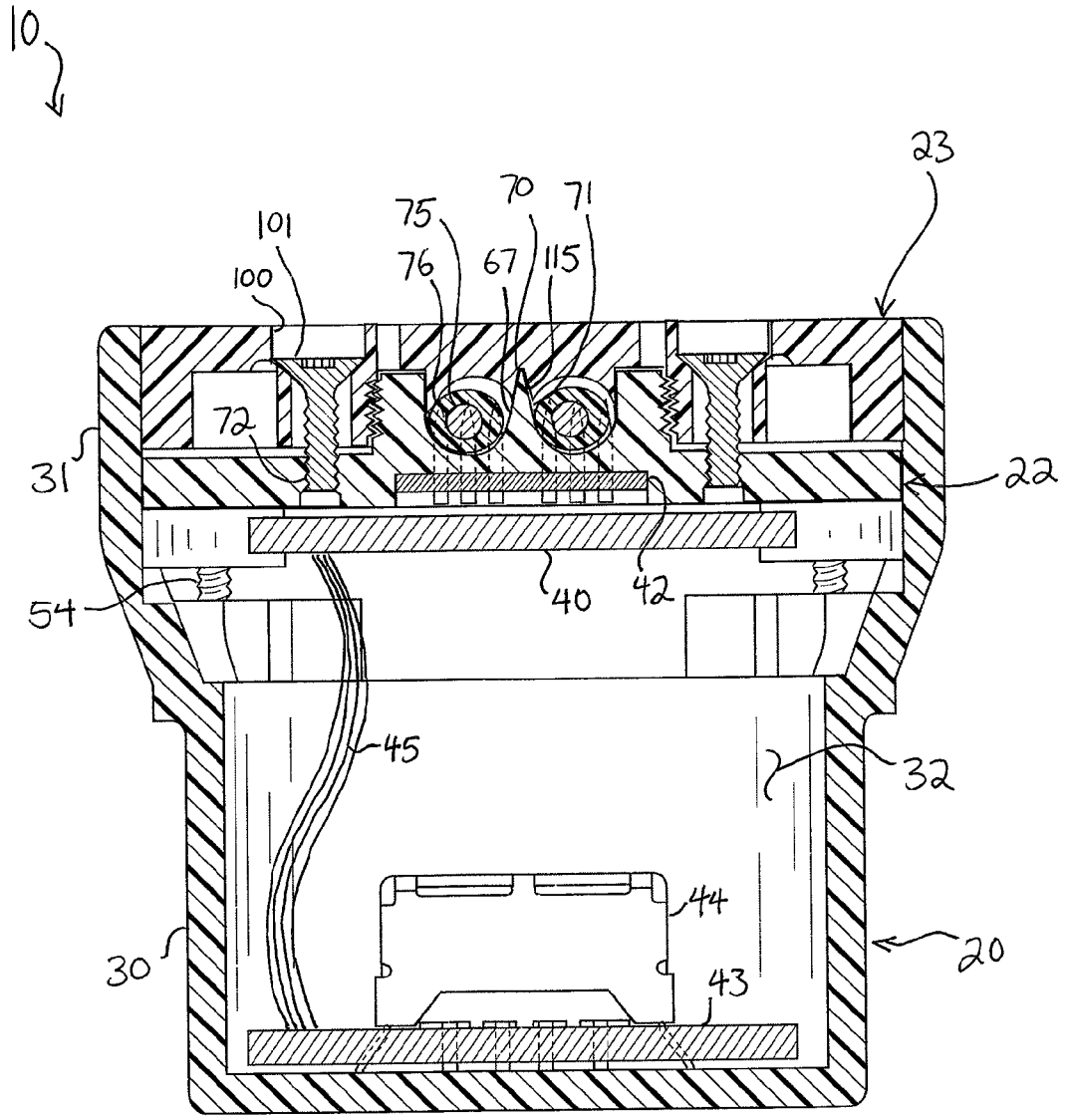
Figure 6B:
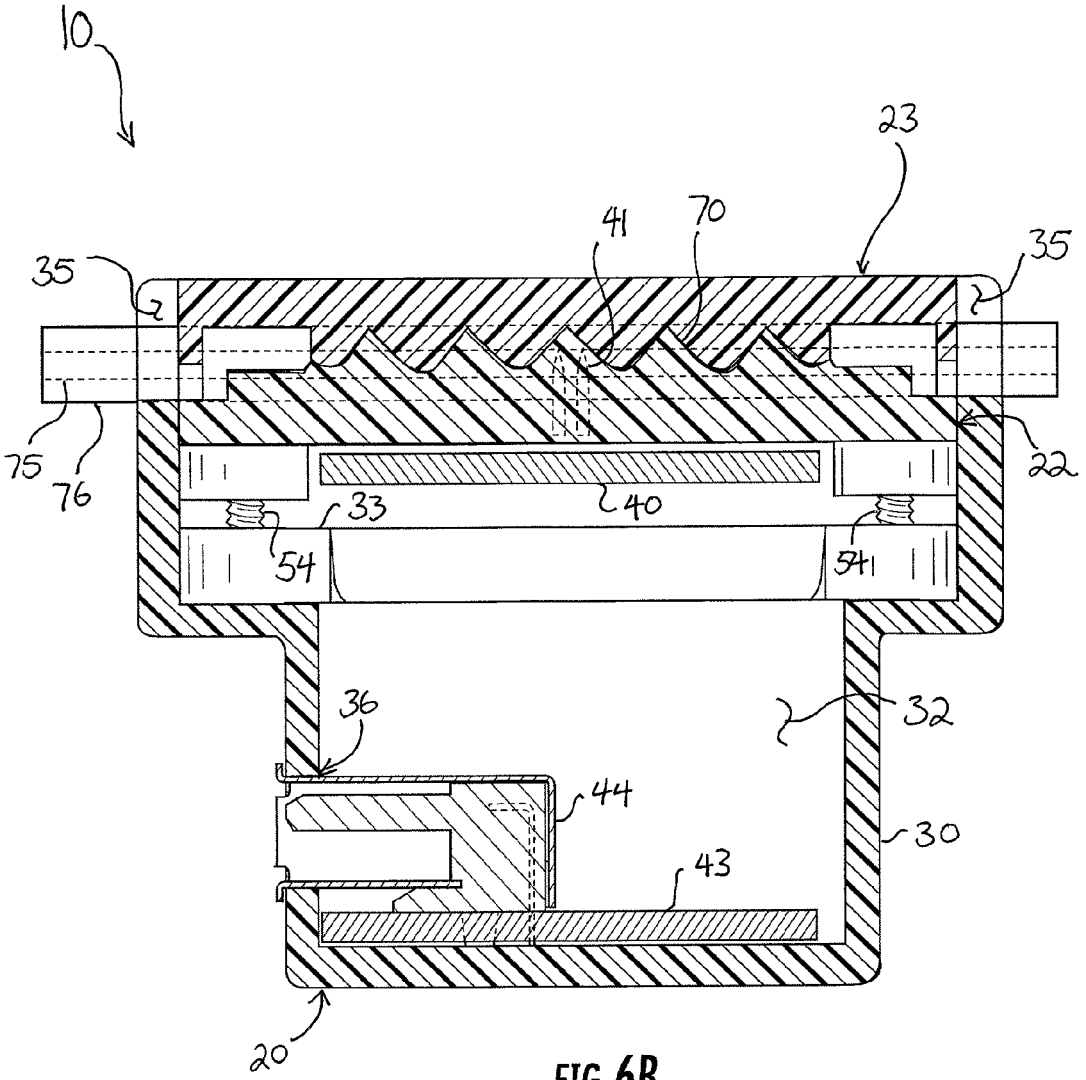

FIGS. 5A and 6A show the power supply 10 without the cord 11 applied, and FIGS. 5B and 6B illustrate the cord 11 applied. FIGS. 5A and 6A thus show the power supply 10 as it might be arranged during shipping, or prior to use. To change the power supply from the arrangement shown in FIGS. 5A and 6A to that shown in FIGS. 5B and 6B, the user must assemble the power supply 10 on the cord 11.

Referring still to FIGS. 5A and 6A, the user first removes the cover 23 by threadably disengaging the fasteners 101 which extend from and bind the cover 23 to the carrier plate 22. The carrier plate 22 is fastened to the housing 20 with the fasteners 54. Thus, removing the cover 23 does not remove the carrier plate 22.

The cord 11 is taken up by hand and laid into the housing 10, with the cord 11 aligned through the notches 35 and over the blade 70. The cover 23 is then brought over the carrier plate 22 in the housing 20. The cover 23 is registered with the carrier plate 22, aligning the holes 100 with the holes 72, the split ridge 114 with the blade 70, the channels 112 and 113 with the channels 66 and 67, and the lips 103 and 104 with the sides 61 and 62. With the cord 11 gently placed over the blade 70, the cover 23 is pressed into the carrier plate 22. The ridges 110 of the upstanding lips 103 and 104 move over the ridges 65 of the carrier plate 22, snappingly and meshingly engage the ridges 65 as they so move. The cover 23 thus clicks into place, enclosing the interior 32 of the housing 20.

As the cover 23 is moved toward the carrier plate 22, the two cables 76 are separated by the blade 70 and the crown 71 just below it, allowing the two cables 76 of the cord 11 to separate and move into centered positions in the holds 120 and 121. The two cables 76 are moved into and captured by the holds 120 and 121. The concave shape of the channels 66, 67, 112, and 113 causes the two cables 76 to move into low points at the centers of the channels 66, 67, 112, and 113. This ensures that the conducting wires 75 are separated from each other and also that the wires 75 are located so as to be reliably pierced by the spikes 41.

As the user continues to press the cover 23 into the carrier plate 22, the spikes 41 pierce the insulated cables 76 and the wires 75. Thus, conductive contact is made between the spikes 41 and the wires 75. At this point, power is provided from the cord 11 through the spikes 41 to the PCB 40, and from the PCB 40 through the ribbon cable 45 to the PCB 43 and USB port 44. The power supply 10 is thus powered. However, because of the snap-fit between the ridges 66 and 112 and between the ridges 67 and 113, the cover 23 cannot be easily removed, so the risk of electrical shock is mitigated. The fasteners 101 are applied through the holes 100 in the cover 23 and are threadably engaged with the holes 53 in the carrier plate 22. The flexibility of the panels 85 and 86 allows the cover 23 to be tightly fastened to the housing 20 without comprising the engagement of the cables 76 of the cord 11 within the holds 120 and 121. In this way, assembly onto the cord 11 is complete, and the power supply 10 is ready for use. A user need only pick up a charging cable 13 and plug the male USB end of it into the USB port 44.

Once so installed, the power supply 10 is used until the user desires to remove it. To remove the power supply 10 from the cord 11, the user backs the fasteners 101 out of the cover 23 and the carrier plate 22, then pulls the cord 11 out from the channels 66 and 67. This disengages the cord 11 from the power supply 10. The pins 41 are the only element that pierces the cord 11, and the pins 41 are quite small. As such, the holes formed through the jackets of the cables 76 of the cord 11 are also quite small, and the risk of electric shock therefrom is correspondingly small. The user may, if desired, wrap the affected portion of the cord 11 with electrical tape to further protect the cord 11.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that such modifications do not depart from the spirit of the invention, they are intended to be included within the scope thereof.

The invention claimed is:

1. A modular power supply for connecting to a power cord, the modular power supply comprising:

a housing defining an interior, and a cover releasably engaged to the housing to enclose the interior;

a carrier plate within the interior including opposed primary channels configured to receive the power cord;

secondary channels on the cover, opposite the primary channels on the carrier plate;

a control assembly within the interior, the control assembly including a logic controller electrically coupled to spikes extending outside of the control assembly and through the primary channels, and a charging port electrically coupled to the spikes via the logic controller; and a blade between the primary channels configured to separate the power cord into the primary channels, and a ridge between the secondary channels including an elongate depression configured to receive the blade therein;

wherein the cover is applicable to the carrier plate to define a hold that captures the power cord on the spikes in the primary channels when the power cord is applied to the primary channels.

2. The modular power supply of claim 1, further comprising:

a fastener extending through and engaging the cover to the carrier plate; and a different fastener extending through and engaging the carrier plate to the housing.

3. The modular power supply of claim 1, further comprising secondary channels on the cover, opposite the primary channels on the carrier plate, wherein the primary and secondary channels cooperate to form the hold.

4. The modular power supply of claim 3, wherein:

the primary channels on the carrier plate have outer sides which are ridged; and two upstanding lips extending from the cover and registered with the outer sides of the primary channels, the lips each being ridged so as to meshingly engage with the outer sides of the primary channels when the cover is applied to the carrier plate.

5. The modular power supply of claim 4, wherein the cover includes:

a planar body and slots formed into the planar body; and flexible panels defined by the slots, the panels being flexible into and out of planar alignment with the planar body;

wherein the lips are formed on the flexible panels.

6. A modular power supply for connecting to a power cord, the modular power supply comprising:

a housing defining an interior, and a cover releasably engaged to the housing to enclose the interior;

a carrier plate within the interior including opposed primary channels configured to receive the power cord;

secondary channels on the cover, opposite the primary channels on the carrier plate;

a blade between the primary channels, and a ridge between the secondary channels including an elongate depression configured to receive the blade therein;

a control assembly carried within the interior, the control assembly including a logic controller electrically coupled to spikes extending outside of the control assembly and through the primary channels, and a charging port electrically coupled to the spikes via the logic controller.

7. The modular power supply of claim 6, further comprising:

a fastener extending through and engaging the cover to the carrier plate; and a different fastener extending through and engaging the carrier plate to the housing.

8. The modular power supply of claim 6, further comprising secondary channels on the cover, opposite the primary channels on the carrier plate.

9. The modular power supply of claim 8, wherein:

the primary channels on the carrier plate have outer sides which are ridged; and two upstanding lips extending from the cover and registered with the outer sides of the primary channels, the lips each being ridged so as to meshingly engage with the outer sides of the primary channels.

10. The modular power supply of claim 9, wherein the cover includes:

a planar body and slots formed into the planar body; and flexible panels defined by the slots, the panels being flexible into and out of planar alignment with the planar body;

wherein the lips are formed on the flexible panels.

11. A modular power supply for connecting to a power cord, the modular power supply comprising:

a housing defining an interior, and a cover releasably engaged to the housing to enclose the interior;

a carrier plate within the interior including opposed primary channels configured to receive the power cord with a blade disposed between the primary channels;

secondary channels on the cover, opposite the primary channels on the carrier plate;

a ridge between the secondary channels including an elongate depression configured to receive the blade therein; and a control assembly within the interior, the control assembly including a logic controller electrically coupled to spikes extending outside of the control assembly and through the primary channels, and a charging port electrically coupled to the spikes via the logic controller.

12. The modular power supply of claim 11, further comprising:

a fastener extending through and engaging the cover to the carrier plate; and a different fastener extending through and engaging the carrier plate to the housing.

13. The modular power supply of claim 11, further comprising secondary channels on the cover, opposite the primary channels on the carrier plate.

14. The modular power supply of claim 13, wherein:

the primary channels on the carrier plate have outer sides which are ridged; and two upstanding lips extending from the cover and registered with the outer sides of the primary channels, the lips each being ridged so as to meshingly engage with the outer sides of the primary channels.

15. The modular power supply of claim 14, wherein the cover includes:

a planar body and slots formed into the planar body; and flexible panels defined by the slots, the panels being flexible into and out of planar alignment with the planar body;

wherein the lips are formed on the flexible panels.

* * * * *